US008516941B1

(12) United States Patent
Oliver

(10) Patent No.: US 8,516,941 B1
(45) Date of Patent: Aug. 27, 2013

(54) INTERCHANGEABLE, MODULAR FIREARM MOUNTABLE DEVICE

(75) Inventor: Russell Oliver, Sandy, UT (US)

(73) Assignee: O.S.S. Holdings, LLC, Murray, UT (US)

( * ) Notice: Subject to any disclaimer, the term of this patent is extended or adjusted under 35 U.S.C. 154(b) by 0 days.

(21) Appl. No.: 13/025,954

(22) Filed: Feb. 11, 2011

Related U.S. Application Data

(60) Provisional application No. 61/303,553, filed on Feb. 11, 2010, provisional application No. 61/418,311, filed on Nov. 30, 2010.

(51) Int. Cl.
*F41A 21/30* (2006.01)

(52) U.S. Cl.
USPC ..... 89/14.4; 89/14.2; 181/223

(58) Field of Classification Search
USPC ..... 89/14.2, 14.3, 14.4; 181/223; 42/79, 42/77
See application file for complete search history.

(56) References Cited

U.S. PATENT DOCUMENTS

| | | | | |
|---|---|---|---|---|
| 748,157 | A | 12/1903 | Bouton | |
| 822,127 | A | 5/1906 | Hufnagel | |
| 916,885 | A | 3/1909 | Maxim | |
| 1,427,802 | A | 9/1922 | Goodwin | |
| 1,462,158 | A | 7/1923 | Wildner | |
| 1,736,319 | A | 11/1929 | Maxim | |
| 1,773,443 | A | 8/1930 | Wilman | |
| 2,165,457 | A * | 7/1939 | Cutts, Jr. | 89/14.3 |
| 2,514,996 | A | 7/1950 | Faust, Jr. | |
| 3,667,570 | A | 6/1972 | WerBell, III | |
| 3,693,750 | A | 9/1972 | Takkunen | |
| 3,698,747 | A * | 10/1972 | Wing et al. | 285/305 |
| 4,454,798 | A | 6/1984 | Shea et al. | |
| 4,482,027 | A | 11/1984 | Gould | |
| 4,501,189 | A | 2/1985 | Brandl et al. | |
| 4,510,843 | A | 4/1985 | Rabatin | |
| 4,530,417 | A | 7/1985 | Daniel | |
| 4,576,083 | A | 3/1986 | Seberger, Jr. | |
| 4,907,488 | A | 3/1990 | Seberger | |

(Continued)

FOREIGN PATENT DOCUMENTS

| | | | |
|---|---|---|---|
| GB | 743111 | A | 11/1956 |
| GB | 2287780 | A | 9/1995 |

(Continued)

OTHER PUBLICATIONS

U.S. Appl. No. 13/025,989, filed Feb. 11, 2011; Russell Oliver; office action issued Sep. 30, 2011.

(Continued)

*Primary Examiner* — Benjamin P Lee
(74) *Attorney, Agent, or Firm* — Thorpe North & Western LLP

(57) ABSTRACT

An interchangeable, modular firearm muzzle mountable device can include a central chamber oriented along a central axis within an outer shell. The central chamber can have an inlet at an inlet end and an outlet at an outlet end to allow a projectile from a firearm to pass along the central axis. The device can also include an inlet end coupling feature proximate to the inlet end, to removably couple with a muzzle end of a firearm. Additionally, the device can include an outlet end coupling feature proximate to the outlet end, to removably couple with a secondary firearm muzzle mountable device beyond the muzzle end of the firearm.

21 Claims, 4 Drawing Sheets

(56) References Cited

U.S. PATENT DOCUMENTS

| | | | | |
|---|---|---|---|---|
| 4,974,489 | A | 12/1990 | Fishbaugh | |
| 5,010,676 | A | 4/1991 | Kennedy | |
| 5,029,512 | A | 7/1991 | Latka | |
| 5,036,747 | A | 8/1991 | McClain, III | |
| 5,078,043 | A | 1/1992 | Stephens | |
| 5,164,535 | A | 11/1992 | Leasure | |
| 5,433,133 | A | 7/1995 | La France | |
| 5,486,425 | A | 1/1996 | Seibert | |
| 5,590,484 | A | 1/1997 | Mooney et al. | |
| 5,656,166 | A | 8/1997 | Linnersten et al. | |
| 5,661,255 | A | 8/1997 | Webb, III | |
| 5,679,916 | A | 10/1997 | Weichert | |
| 5,698,810 | A | 12/1997 | Rose | |
| 5,777,258 | A | 7/1998 | Soon | |
| 5,860,242 | A | 1/1999 | O'Neil | |
| 5,952,625 | A | 9/1999 | Huff | |
| 6,079,311 | A | 6/2000 | O'Quinn et al. | |
| 6,298,764 | B1 | 10/2001 | Sherman et al. | |
| 6,302,009 | B1 | 10/2001 | O'Quinn et al. | |
| 6,308,609 | B1 * | 10/2001 | Davies | 89/14.4 |
| 6,374,718 | B1 * | 4/2002 | Rescigno et al. | 89/14.4 |
| 6,376,565 | B1 | 4/2002 | Dyer et al. | |
| 6,425,310 | B1 | 7/2002 | Champion | |
| 6,490,822 | B1 | 12/2002 | Swan | |
| 6,499,245 | B1 | 12/2002 | Swan | |
| 6,575,074 | B1 | 6/2003 | Gaddini | |
| 6,732,628 | B1 | 5/2004 | Coburn et al. | |
| 6,792,711 | B2 | 9/2004 | Battaglia | |
| 6,796,214 | B2 | 9/2004 | Hausken et al. | |
| 6,959,509 | B2 | 11/2005 | Vais | |
| 7,000,547 | B2 | 2/2006 | Amick | |
| 7,036,259 | B2 | 5/2006 | Beretta | |
| 7,059,233 | B2 | 6/2006 | Amick | |
| 7,059,235 | B2 * | 6/2006 | Hanslick et al. | 89/14.3 |
| 7,131,228 | B2 | 11/2006 | Hochstrate et al. | |
| 7,207,258 | B1 | 4/2007 | Scanlon | |
| 7,216,451 | B1 | 5/2007 | Troy | |
| 7,237,467 | B1 | 7/2007 | Melton | |
| 7,308,967 | B1 | 12/2007 | Hoel | |
| 7,325,474 | B2 | 2/2008 | Yoshimura et al. | |
| 7,353,740 | B1 | 4/2008 | Hoffman | |
| 7,412,917 | B2 | 8/2008 | Vais | |
| 7,587,969 | B2 | 9/2009 | Silvers | |
| 7,610,710 | B2 | 11/2009 | Brittingham | |
| 7,661,349 | B1 | 2/2010 | Brittingham | |
| 7,676,976 | B2 | 3/2010 | Dueck et al. | |
| 7,707,762 | B1 | 5/2010 | Swan | |
| 7,823,314 | B1 | 11/2010 | Wheatley | |
| 7,905,319 | B2 | 3/2011 | Sullivan | |
| 7,987,944 | B1 | 8/2011 | Brittingham et al. | |
| 2007/0107982 | A1 | 5/2007 | Sullivan | |
| 2007/0256347 | A1 | 11/2007 | Fitzpatrick et al. | |
| 2009/0235568 | A1 | 9/2009 | Auvine | |
| 2010/0048752 | A1 | 2/2010 | Vignola et al. | |
| 2010/0199834 | A1 | 8/2010 | Dueck et al. | |

FOREIGN PATENT DOCUMENTS

| | | | |
|---|---|---|---|
| GB | 2287780 | A | 9/1995 |
| GB | 2288007 | A | 10/1995 |
| WO | WO 9407103 | A1 * | 3/1994 |
| WO | WO-99/02826 | | 1/1999 |

OTHER PUBLICATIONS

U.S. Appl. No. 13/025,973, filed Feb. 11, 2011; Russell Oliver; office action issued Oct. 3, 2011.

Wikipedia, Supressor, http://en.wikipedia.org/wiki/Suppressor, Retrieved Jan. 26, 2010, pp. 1-14.

"JBU 6.5 inch Modular Silencer and Flash Hider System". Web. Apr. 6, 2011. http://www.airsoftatlanta.com/JBU__6__5__inch__Modular__Silencer__and__Flash__Hider__p/52319.htm.

"3.5 MSS (Modular Suppressor System)—(Barrel Extension) by JBU—Airsoft Guns | Trinity Airsoft". Web. Apr. 7, 2011. http://www.trinityairsoft.com/p-1451-35-mss-modular-suppressor-system-barrel-extension-by-jbu.aspx.

Oliver, Russell, U.S. Appl. No. 61/418,311 entitled "Coupling Device, System, and Methods to Maintain Relative Positions Between Two Components", filed Nov. 30, 2010.

Oliver, Russell, U.S. Appl. No. 13/025,941, filed Feb. 11, 2011.

Oliver, Russell, U.S. Appl. No. 13/025,989, filed Feb. 11, 2011.

Oliver, Russell, U.S. Appl. No. 13/025,973, filed Feb. 11, 2011.

U.S. Appl. No. 13/025,989, filed Feb. 11, 2011; Russell Oliver; Notice of Allowance issued Jun. 12, 2012.

* cited by examiner

INTERCHANGEABLE, MODULAR FIREARM MOUNTABLE DEVICE

RELATED APPLICATIONS

This application claims the benefit of U.S. Provisional Application No. 61/303,553, filed Feb. 11, 2010 and U.S. Provisional Patent Application No. 61/418,311, filed Nov. 30, 2010, each of which is incorporated herein by reference.

FIELD OF THE INVENTION

The present invention relates generally to firearm mountable devices. Accordingly, the invention involves the field of mechanical engineering and firearms.

BACKGROUND

In certain tactical situations, a firearm user can benefit from a specific set of firearm attributes that can be achieved through the use of a muzzle mounted device. For example, one tactical situation may require maximum sound suppression while optical heat distortion from a hot sound suppressor may not be a concern. Another tactical situation may require sound suppression and minimal optical heat distortion in addition to minimizing debris that results from discharging the firearm. Additionally, a tactical situation can change such that firearm attributes that were important at an earlier time are of much less importance at a later time. Traditionally, a firearm user had few options for altering the attributes of the firearm using different muzzle mounted devices and very little flexibility, especially in the field. It is desirable, therefore, to create a suitable muzzle mountable device for any given tactical situation.

SUMMARY

An interchangeable, modular firearm muzzle mountable device is disclosed, which can be used to create a customized muzzle mountable system. In anti-terrorism operations, a variety of scenarios are encountered during individual operations. Often such operations can involve dynamic variables which demand different tactical solutions to address specific developments. For example, concealment of the location of firearm operators is critical to hostage rescue, terrorist apprehension, operations protection, dignitary and witness protection, and intelligence gathering operations. These missions are critical to the successful defense of nations from terrorism. However, achieving such concealment while preserving necessary performance of a firearm for a particular scenario can be challenging. Modular and customizable systems for firearms can allow operators to adjust a number of variables in order to more carefully tailor the firearm performance to a specific dynamic operation. Such tailorability can dramatically increase effectiveness and survivability of counter terrorism special forces during such operations. Increased survivability in such scenarios can improve operator performance and decrease collateral costs associated with injuries to highly trained operators.

The modular device can include a central chamber oriented along a central axis within an outer shell. The central chamber can have an inlet at an inlet end and an outlet at an outlet end to allow a projectile from a firearm to pass along the central axis. The device can also include an inlet end coupling feature proximate to the inlet end, to removably couple with a muzzle end of a firearm. Additionally, the device can include an outlet end coupling feature proximate to the outlet end, to removably couple with a secondary firearm muzzle mountable device beyond the muzzle end of the firearm.

An interchangeable, modular firearm muzzle mountable system is also disclosed. The system can include a first firearm muzzle mountable device and a second firearm muzzle mountable device. Each device can have an inlet end coupling feature proximate to an inlet end of a central chamber, and an outlet end coupling feature proximate to an outlet of the central chamber. The central chamber can be oriented along a central axis within an outer shell. The inlet and the outlet can be configured to allow a projectile from a firearm to pass along the central axis. The inlet end coupling feature of the first device can be removably coupleable with a muzzle end of a firearm. The inlet end coupling feature of the second device can be removably coupleable with the outlet end coupling feature of the first device beyond the muzzle end of the firearm.

This device fills a current and immediate capability gap experienced by active anti-terrorist special operation units in the field. The below stated capabilities offer life saving benefits to ground personnel involved in day to day operation including hostage rescue, terrorist apprehension and dignitary protection.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

These figures are provided merely for convenience in describing specific embodiments of the invention. Alteration in dimension, materials, and the like, including substitution, elimination, or addition of components can also be made consistent with the following description and associated claims. Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this invention is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," "an," and "the" include plural referents unless the context clearly dictates otherwise. Thus, for example, reference to "an off axis chamber" includes one or more of such off axis chambers and reference to "a modular device" includes reference to one or more of such modular devices.

In describing and claiming the present invention, the following terminology will be used in accordance with the definitions set forth below.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Any steps recited in any method or process claims may be executed in any order and are not limited to the order presented in the claims unless otherwise stated. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Figure 1:
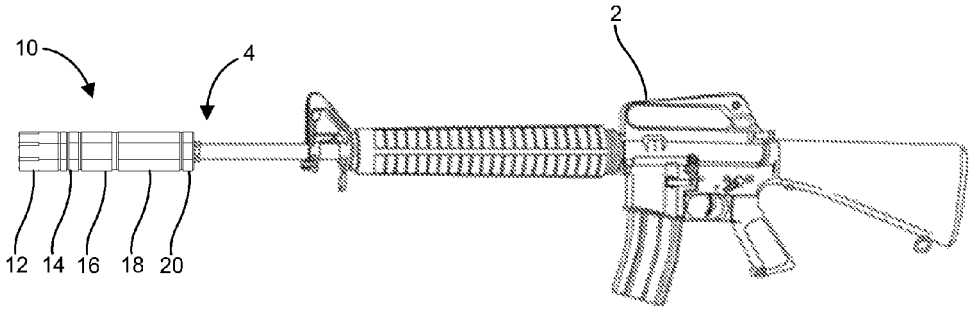
FIG. 1 is an interchangeable, modular firearm muzzle mountable system coupled to a firearm, in accordance with one example of the present disclosure.

With reference to FIG. 1, a firearm 2 is shown with an interchangeable, modular firearm muzzle mountable system 10. The modular system is coupled to a muzzle end 4 of the firearm, which is where a bullet and discharge gases exit the firearm upon firing. The system can include modular devices 12, 14, 16, 18, and 20. The modular devices can be used interchangeably to create a customized muzzle mountable system. For example, one tactical situation may require maximum sound suppression while optical heat distortion from a hot suppressor may not be a concern. In this case, a suitable muzzle mountable system can be created by selecting modular devices that maximize sound suppression and omitting a device such as a heat shield or heat controller. For example, modular devices can include one or more sound suppressor units, gas redirection units, back pressure controller units, dust control units, flash suppressor units, etc. Thus, a variety of modular devices are available to choose from in order to create a suitable muzzle mountable system for a given situation.

Figure 2A:
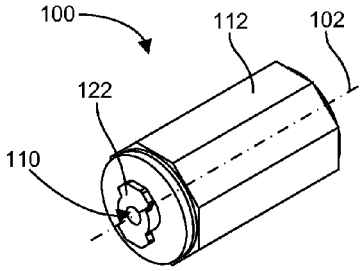
FIG. 2A is a perspective view of an interchangeable, modular firearm muzzle mountable device, in accordance with one example of the present disclosure.
Figure 2B:
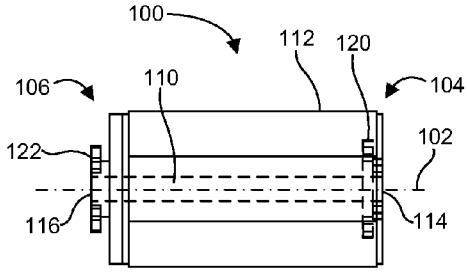
FIG. 2B is a side view of the interchangeable, modular firearm muzzle mountable device of FIG. 2A.

FIGS. 2A and 2B illustrate an interchangeable, modular firearm muzzle mountable device 100, in accordance with the present disclosure. The modular device can function as at least one of a sound suppressor, a flash suppressor, a flow controller, a back pressure controller, a debris controller, and an acoustic and heat controller. Examples of sound suppressors that can be integrated and/or incorporated with modular devices of the present disclosure are disclosed in U.S. Provisional Patent Application No. 61/418,285, filed Nov. 30, 2010, and entitled "Sound Reduction Module." Examples of gas flow controllers that can be integrated and/or incorporated with modular devices of the present disclosure are disclosed in U.S. Provisional Patent Application No. 61/418,294, filed Nov. 30, 2010, and entitled "Firearm Discharge Gas Flow Control." Examples of acoustic and heat controllers that can be integrated and/or incorporated with modular devices of the present disclosure are disclosed in U.S. Pat. No. 8,196,701, and entitled "Acoustic and Heat Control Device." Examples of debris controllers that can be integrated and/or incorporated with modular devices of the present disclosure are disclosed in U.S. patent application Ser. No. 13/025,941, filed Feb. 11, 2011, and entitled "Particulate Capture from a High Energy Discharge Device." Examples of back pressure controllers that can be integrated and/or incorporated with modular devices of the present disclosure are disclosed in U.S. patent application Ser. No. 13/025,954, filed Feb. 11, 2011, and entitled "Firearm Back Pressure Regulator." Each of these applications listed in this paragraph is incorporated here by reference in their entireties.

The modular device can include a central chamber 110 oriented along a central axis 102 within an outer shell 112. The outer shell can be generally tubular and have any suitable cross-section shape. In one aspect, the outer shell has an octagonal cross-section as shown in FIGS. 2A and 2B. The outer shell can optionally have a circular cross-section or any other desired shape (e.g. 5, 6, 7, 9 or 10 sides) and, for example, can have non-parallel sides.

The central chamber 110 can have an inlet 114 at an inlet end 104 and an outlet 116 at an outlet end 106 to allow a projectile from a firearm, such as a bullet, to pass along the central axis 102. Thus, for example, the inlet and the outlet have diameters that are at least large enough to allow a bullet to pass through. This does not mean, however, that the central chamber is necessarily unobstructed. For example, a relatively soft material that is penetrable by the bullet may be located in the ballistic path of the bullet. Such a material and configuration may capture debris passing through the modular device.

The modular device 100 can include an inlet end coupling feature 120 proximate to the inlet end 104. The inlet end coupling feature can be configured to removably couple the modular device with a muzzle end of a firearm. In one aspect, the modular device can couple directly to the firearm. In another aspect, the modular device can couple to an adapter for coupling the modular device to the firearm. In yet another aspect, the modular device can couple to another firearm muzzle mountable device, such as another modular device.

The modular device 100 can also include an outlet end coupling feature 122 proximate to the outlet end 106. The outlet end coupling feature can be configured to removably couple the modular device with another, or a secondary, firearm muzzle mountable device. The secondary device can be configured with a mating coupling feature on its inlet end. Thus, the inlet and outlet coupling features are configured to connect multiple interchangeable, modular firearm muzzle mountable devices in series, where each successive coupling is beyond the muzzle end of the firearm when mounted to the firearm.

Inlet coupling feature 120 and outlet coupling feature 122 can comprise any suitable device or mechanism for coupling two firearm components, such as coupling two modular devices or a modular device and a firearm barrel. For example, the present disclosure contemplates using coupling features such as those disclosed in U.S. Provisional Patent Application No. 61/418,311, filed Nov. 30, 2010, and entitled "Coupling Device, System, and Methods to Maintain Relative Position Between Two Components", which is incorporated by reference herein.

One type of coupling feature that may be used is a bayonet-style connector. A bayonet-style connector can include a bayonet socket with two internal recesses and two diametrically opposed cutouts. The mating bayonet coupling feature can include two bayonet lugs corresponding to the cutouts. The bayonet-style connector is coupled by inserting the bayonet lugs into the cutouts in the socket and rotating the lugs until they are aligned with the internal recesses. Another type of coupling feature that can be used is a lateral sliding connector. This type of connector can include a linear internal recess that is accessible from at least one end. The mating coupling feature can include a linear protrusion having a lug that corresponds to the internal recess. The sliding connector is coupled by sliding the linear lug into the linear recess. Thus, the inlet and outlet coupling features can include bayonet-style connectors, lateral sliding connectors, or any other suitable connector, or combination of connectors. Non-limiting examples of other suitable engagement mechanisms can include threaded engagement, recessed locking, interference fit, detent locking, and the like.

Figure 3A:
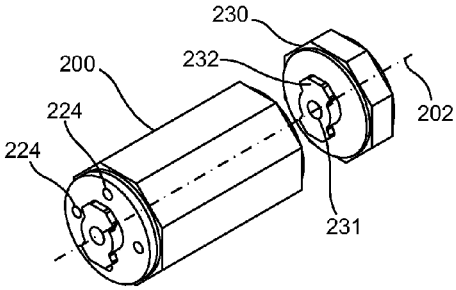
FIG. 3A is a perspective view of an interchangeable, modular firearm muzzle mountable device and an adapter, in accordance with another example of the present disclosure.
Figure 3B:
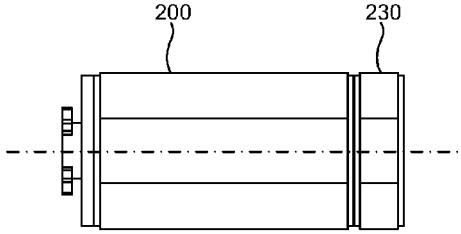
FIG. 3B is a side view of the interchangeable, modular firearm muzzle mountable device and adapter of FIG. 3A.
Figure 3C:
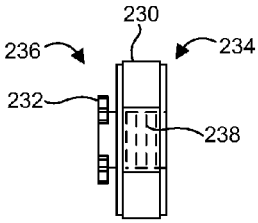
FIG. 3C is a detailed view of the adapter in FIGS. 3A and 3B.

FIGS. 3A and 3B illustrate an example of an interchangeable, modular firearm muzzle mountable device 200 with an adapter 230 for coupling the modular device to a firearm. Depending on the type of inlet coupling feature present on the modular device, an adapter may be needed to couple the modular device with a muzzle end of a firearm. For example, a muzzle end of a firearm may often have a threaded coupling feature on the outer surface of the muzzle end of the barrel, but the modular device may have a bayonet-style inlet coupling feature. In this case, an adapter 230, shown in more detail in FIG. 3C, can include mating threads 238 at an inlet end 234 to couple with the threads on the firearm. Additionally, the adapter can include a mating bayonet-style coupling feature 232 at an outlet end 236 to mate and couple with the bayonet-style inlet coupling feature of the modular device. Of course, the adapter also includes an opening 231 configured to allow a bullet to pass through the adapter.

In one aspect, as illustrated in FIG. 3A, the modular device 200 can include at least one off axis chamber 224 relative to the axis 202. At least some discharge gases from firing a firearm can be directed into the off axis chamber. When multiple interchangeable, modular firearm mountable devices are connected in series, the optional off axis chambers of each modular device can be aligned, such that discharge gases can pass through the off axis chambers from one modular device to the next. Specifically, the outlet end coupling feature of one modular device can removably couple with another, or secondary, firearm muzzle mountable device such that the off axis chamber outlet is aligned with an off axis chamber inlet of the other device. When the modular device 200 includes an off axis chamber 224, the adapter 230, which does not include an off axis chamber, can also serve to block gases from exiting the off axis chamber that would otherwise be free to flow toward the firearm user. Off axis chambers are discussed in more detail below, with reference to FIGS. 5A-5C.

Figure 4:
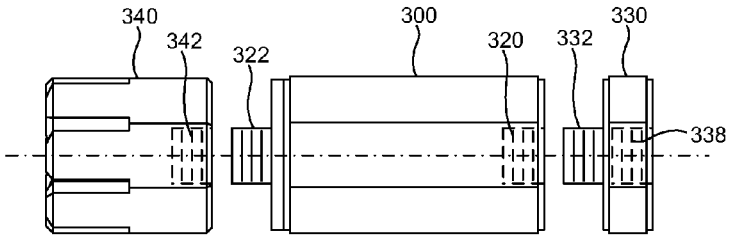
FIG. 4 is a side view of an interchangeable, modular firearm muzzle mountable device in accordance with an example of the present disclosure.

FIG. 4 illustrates an interchangeable, modular firearm muzzle mountable arrangement utilizing threaded coupling features. For example, modular device 300 includes an inlet end coupling feature 320 and an outlet end coupling feature 322, each comprising a threaded connector. Depending on the characteristics of a threaded connector on a muzzle end of a firearm, the adapter 330 may not be necessary to couple the modular device to the firearm and would, therefore, be optional. However, even in this case the adapter may be useful in blocking discharge gas flow out an off axis chamber of the modular device (if the modular device includes an off axis chamber). In some cases, the threaded connector of the modular device may not be compatible with the threaded connector of the firearm. In these cases, the adapter can have a threaded connector 338 that is compatible with the firearm threaded connector and threaded connector 332 that is compatible with the threaded connector 320 of the modular device.

The threaded outlet coupling feature 322 is shown being coupled to a thread coupling feature 342 of another firearm muzzle mountable device 340 (i.e. a flash hider or flash suppressor). In this case, the flash hider device 340 is configured to couple only at its inlet end. In other words, no other coupling features are included on the device 340 and, thus, the device is intended to be the last device in a series of devices. In this case, the device 340 is a flash suppressor unit, although the device could have any function.

Figure 5A:
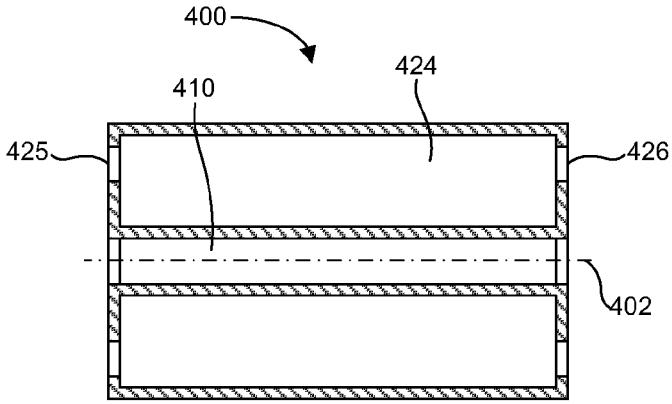
FIG. 5A is a cross-sectional schematic view of an interchangeable, modular firearm muzzle mountable device in accordance with yet another example of the present disclosure.
Figure 5B:
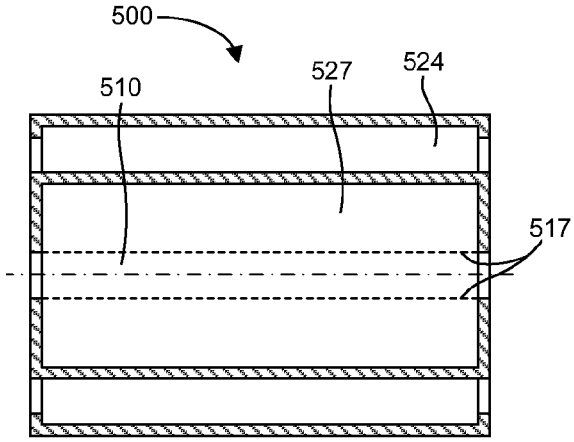
FIG. 5B is a cross-sectional schematic view of an interchangeable, modular firearm muzzle mountable device in accordance with still another example of the present disclosure.
Figure 5C:
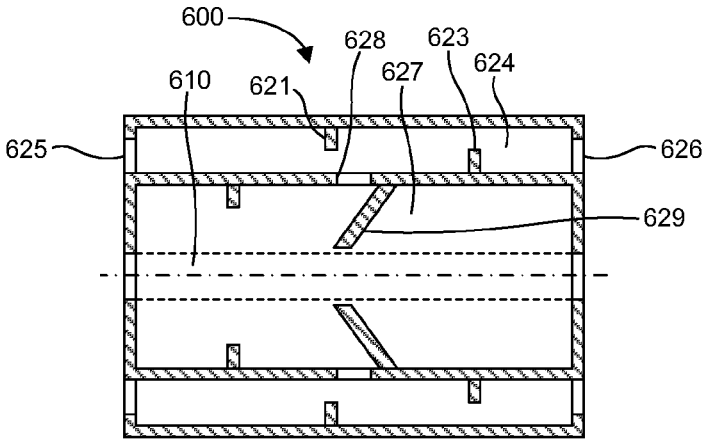
FIG. 5C is a cross-sectional schematic view of an interchangeable, modular firearm muzzle mountable device in accordance with a further example of the present disclosure.

With reference to FIGS. 5A-5C, several different aspects of an interchangeable, modular firearm muzzle mountable device are illustrated with particular emphasis on off axis chambers. These figures represent schematic cross-sectional views of various modular devices that are sectioned through a central axis to illustrate various aspects of the present disclosure. The shape or geometry of the devices and elements of the devices is not to be limited. Thus, for example, the devices and/or elements can be revolute about the central axis or parallel to the central axis at the cross sections shown. Additionally, features such as connectors, fasteners, threads, joints, and the like are not shown in order to simplify the figures. Such features can be integrally formed or separately attached with the devices or any component of the devices shown.

With reference to FIG. 5A, modular device 400 illustrates an off axis chamber 424 relative to central axis 402. Discharge gases can enter the off axis chamber via inlet 425 and exit the off axis chamber via outlet 426. In one aspect, the off axis chamber 424 can be fluidly isolated from the central chamber 410. In this case, discharge gases in the central chamber and the off axis chamber will not mix while in the modular device.

In one aspect, illustrated in FIG. 5B, a modular device 500 can include multiple off axis chambers. For example, the device can include off axis chamber 524 (outer chamber) and off axis chamber 527 (inner chamber). The central chamber 510 is defined, at least in part, by boundary 517, which defines the ballistic path of a bullet through the device. The inner chamber 527 is outside this boundary, which, in this case, is not a physical boundary. Thus, the inner chamber is in fluid communication with the central chamber. In certain aspects, the boundary between the central chamber and the inner chamber can be a physical boundary that can have an opening fluidly connecting the central chamber and the inner chamber. Optionally, the inner chamber can be fluidly isolated from the central chamber. In this example, the outer chamber is fluidly isolated from the central chamber and inner chamber.

In another aspect, illustrated in FIG. 5C, a modular device 600 can include an outer off axis chamber 624 in fluid communication with a central chamber 610. The outer chamber, in this example, is in fluid communication with the central chamber via opening 628. Fluid communication between the central chamber and an off axis chamber, such as the inner chamber or the outer chamber, can allow discharge gases to enter the off axis chamber, which can serve to reduce pressure in the central chamber. A reduction of pressure in the central chamber can reduce acoustic noise levels. Thus, in one aspect, the off axis chambers in this example (i.e. inner chamber 627 and outer chamber 624) can form at least a part of a firearm sound suppressor.

In certain aspects, an off axis chamber can include a set of baffles or flow directors. For example, the inner chamber 627 can have a baffle 629 that directs gas flow through the opening 628 and into the outer chamber 624. Although a single baffle is illustrated for clarity, most configurations will include several sets of baffles (i.e. three to eight or more depending on the length). The outer chamber can include baffles 621, 623 to direct gas flow in the outer chamber. Any number of baffles in any configuration can be utilized. For example, baffles can comprise multiple internal walls configured to produce an axially serpentine fluid pathway that dissipates energy transferred from discharge gases. Alternatively, or in addition, baffles can be baffles oriented in series along the central axis.

The outer chamber outlet 626 can provide an escape for gases from the outer chamber, which can reduce the amount of gas that will escape the outer chamber via the opening 628 to the central chamber 610. The outer chamber outlet can be in fluid communication with another firearm muzzle mounted device, such as a modular pressure regulator or modular flash suppressor. In this case, discharge gases can pass from the modular device 600, via the central chamber and the outer chamber, to another firearm mountable device.

The outer chamber 624 can include an inlet 625 that can receive gases from another device or source. For example, a first modular device, such as a modular pressure regulator or modular particulate capturing device, can be coupled between a second modular device, such as the modular device 600, and a firearm. In this case, discharge gases can pass from the first modular device to the second modular device, and into the central chamber 610 and the outer chamber 624.

Although the various components of the device can be formed of any suitable material, major structural components such as the outer shell and coupling features can be formed substantially of titanium or other suitably strong, lightweight material. Using a lightweight material where possible can be beneficial in a firearm application to minimize the mass at or beyond the muzzle of the firearm. Excessive mass at or beyond the muzzle can compromise the firearm's balance and, thus, can have a negative impact on shooting performance. In general, weight added to the muzzle end of a firearm should not exceed about 1.5-2 pounds. Non-limiting examples of other suitable materials can include high impact polymers, stainless steels, aluminum, molybdenum, refractory metals, super alloys, aircraft alloys, carbon steels, composites thereof, and the like. One or more of the individual components can further include optional coatings such as, but not limited to, diamond coatings, diamond-like carbon coatings, molybdenum, tungsten, tantalum, carbides thereof, and the like can also be used. These components can be molded, cast, machined, deposited or formed in any suitable manner. Currently, machining can be particularly desirable but is not required.

In accordance with the present disclosure, an interchangeable, modular firearm muzzle mountable system can comprise a plurality of interchangeable, modular firearm muzzle mountable devices, as in any of the examples discussed above.

Figure 6A:
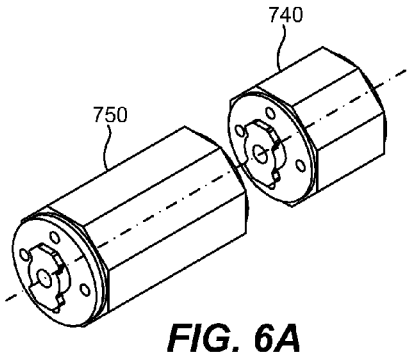
FIG. 6A is a perspective view of an interchangeable, modular firearm muzzle mountable system, in accordance with an example of the present disclosure.
Figure 6B:
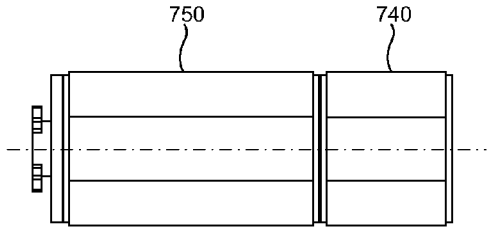
FIG. 6B is a side view of the interchangeable, modular firearm muzzle mountable system of FIG. 6A.

For example, as illustrated in FIGS. 6A and 6B, the first modular device can be a debris capturing device 740 and the second modular device can be a sound suppressor 750. Thus, in one aspect, the second modular device has a function different than a function of the first modular device. These modular devices can be removably coupleable with one another. Therefore, the system can be reconfigured to achieve a customized combination of attributes from the assembled modular devices.

Figure 7A:
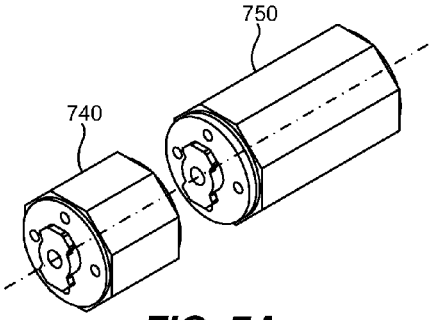
FIG. 7A is a perspective view of an interchangeable, modular firearm muzzle mountable system, in accordance with another example of the present disclosure.
Figure 7B:
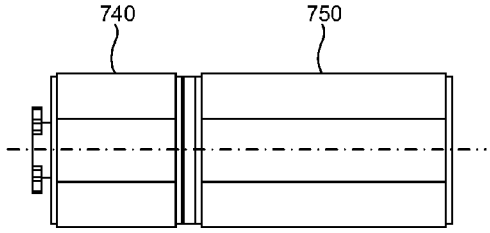
FIG. 7B is a side view of the interchangeable, modular firearm muzzle mountable system of FIG. 7A.

Furthermore, as illustrated in FIGS. 7A and 7B, the first and second modular devices can be reordered, such that the debris capturing device 740 is coupled to the outlet end of the sound suppressor 740.

Figure 8A:
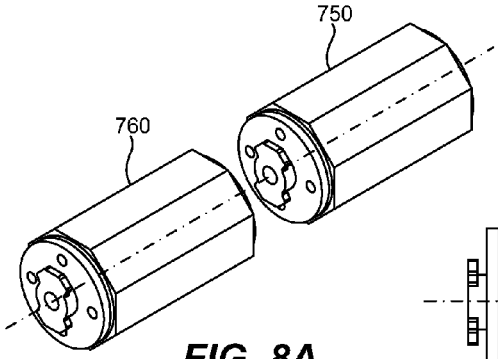
FIG. 8A is a perspective view of an interchangeable, modular firearm muzzle mountable system, in accordance with yet another example of the present disclosure.
Figure 8B:
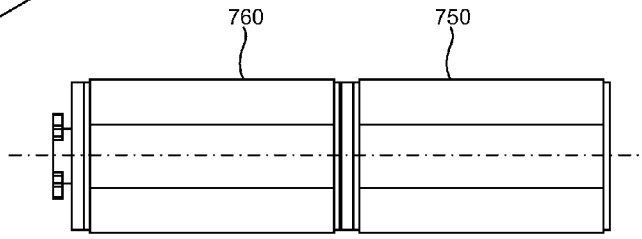
FIG. 8B is a side view of the interchangeable, modular firearm muzzle mountable system of FIG. 8A.

In another example, as illustrated in FIGS. 8A and 8B, the debris capturing device can be replaced with a second sound suppressor 760, if desired, to couple with the first sound suppressor 750. Such a configuration could provide enhanced sound suppression. Thus, in one aspect, the first and second modular components can have the same function.

Figure 9A:
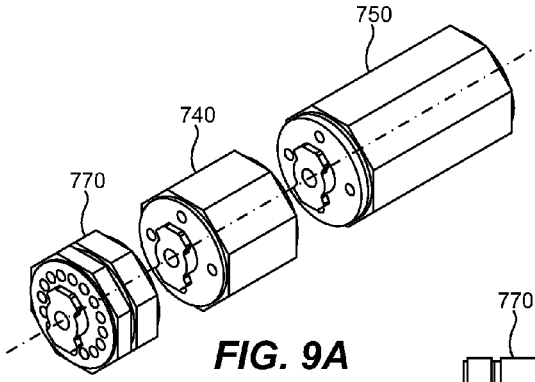
FIG. 9A is a perspective view of an interchangeable, modular firearm muzzle mountable system, in accordance with still another example of the present disclosure.
Figure 9B:
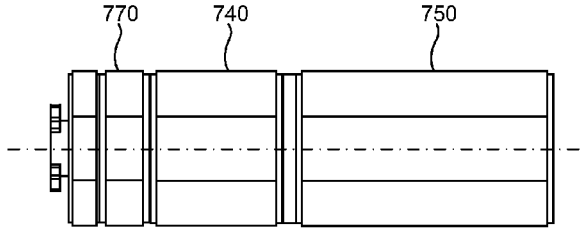
FIG. 9B is a side view of the interchangeable, modular firearm muzzle mountable system of FIG. 9A.

In a further illustration of the modular system of the present disclosure, shown in FIGS. 9A and 9B, a third modular device can be coupled to first and second modular devices. For example, discharge gas flow controller 770 can be coupled to sound suppressor 750 and debris capturing device 740 to form a series of interchangeable, modular firearm muzzle mountable devices.

Figure 10A:
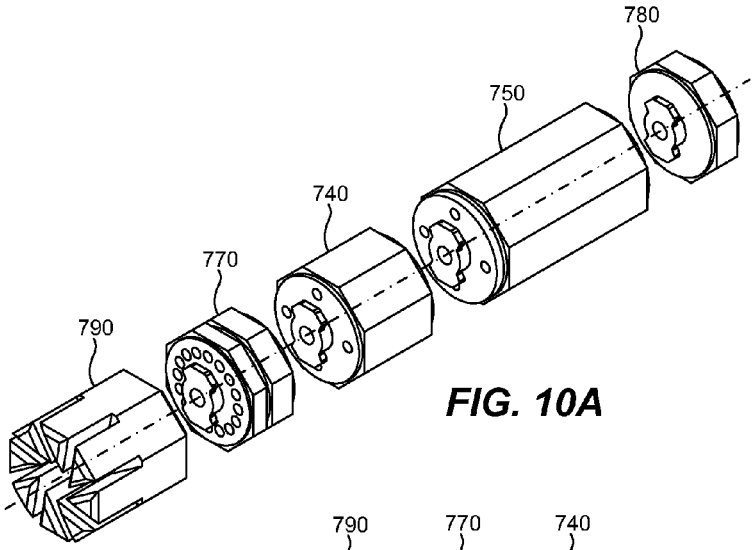
FIG. 10A is a perspective view of an interchangeable, modular firearm muzzle mountable system, in accordance with a further example of the present disclosure.
Figure 10B:
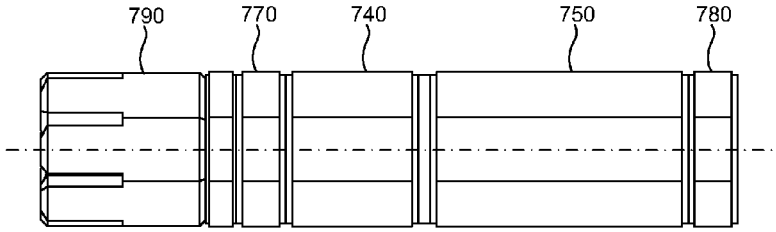
FIG. 10B is a side view of the interchangeable, modular firearm muzzle mountable system of FIG. 10A.

As shown and described above, modular devices having coupling features at both the inlet and outlet ends can be utilized in any order in the system. However, as illustrated in FIGS. 10A and 10B, modular devices having coupling features that are compatible with other modular devices on only one end (i.e. the inlet end or the outlet end), such as adapter 780 and flash suppressor 790, can be coupled to any of the other components and incorporated into the system. For example, the adapter 780 can be coupled to the sound suppressor 750, the sound suppressor can be coupled to the debris capturing device 740, the debris capturing device can be coupled to the discharge gas flow controller 770, and the discharge gas flow controller can be coupled to the flash suppressor 790. "Single-ended" modular devices, such as the adapter and the flash suppressor in the above example, can be considered as end pieces in the modular system. Thus, it has been described and shown that the modular devices of the present disclosure can be selected, replaced, or rearranged to create a firearm muzzle mountable system having a desired set of attributes.

It is to be understood that the above-referenced embodiments are illustrative of the application for the principles of the present invention. Numerous modifications and alternative arrangements can be devised without departing from the spirit and scope of the present invention while the present invention has been shown in the drawings and described above in connection with the exemplary embodiment(s) of the invention. It will be apparent to those of ordinary skill in the art that numerous modifications can be made without departing from the principles and concepts of the invention as set forth in the claims.

What is claimed is:

1. An interchangeable, modular firearm muzzle mountable device, comprising:

a central chamber oriented along a central axis within an outer shell, said central chamber having an inlet at an inlet end and an outlet at an outlet end to allow a projectile from a firearm to pass along the central axis;

a common off axis chamber among a plurality of inlets or openings to the off axis chamber and having an off axis fluid outlet at the outlet end, wherein the off axis chamber is oriented within the outer shell extending from the inlet end to the outlet end;

an inlet end coupling feature proximate to the inlet end, to removably couple with a muzzle end of a firearm; and an outlet end coupling feature proximate to the outlet end, to removably couple with a secondary firearm muzzle mountable device beyond the muzzle end of the firearm, wherein the outlet end coupling feature removably couples with the secondary firearm muzzle mountable device such that the common off axis chamber outlet is aligned with an off axis chamber inlet of the secondary firearm muzzle mountable device.

2. The device of claim 1, wherein the inlet end coupling feature comprises a threaded connector.

3. The device of claim 1, wherein the inlet end coupling feature comprises a bayonet-style connector.

4. The device of claim 1, wherein the inlet end coupling feature comprises a lateral sliding connector.

5. The device of claim 1, wherein the outlet end coupling feature comprises a threaded connector.

6. The device of claim 1, wherein the outlet end coupling feature comprises a bayonet-style connector.

7. The device of claim 1, wherein the outlet end coupling feature comprises a lateral sliding connector.

8. The device of claim 1, wherein the device functions as at least one of a sound suppressor, a flash suppressor, a gas redirector, a back pressure controller, a debris controller, and an acoustic and heat controller.

9. The device of claim 1, wherein the outer shell has an octagonal cross-section.

10. The device of claim 1, wherein the outer shell is formed substantially of titanium.

11. The device of claim 1, wherein the common off axis chamber is in fluid communication with the central chamber.

12. The device of claim 1, further comprising: an off axis inlet for the common off axis chamber at the inlet end.

13. The device of claim 1, wherein the secondary firearm muzzle mountable device comprises a second off axis chamber in fluid communication with the off axis chamber inlet of the secondary firearm muzzle mountable device, and wherein the second off axis chamber is common among a plurality of inlets or openings to the second off axis chamber.

14. An interchangeable, modular firearm muzzle mountable system, comprising:

a first firearm muzzle mountable device and a second firearm muzzle mountable device, each device having an inlet end coupling feature proximate to an inlet end of a central chamber, and an outlet end coupling feature proximate to an outlet of the central chamber, the central chamber being oriented along a central axis within an outer shell and the inlet and the outlet being configured to allow a projectile from a firearm to pass along the central axis, wherein the inlet end coupling feature of the first device is removably coupleable with a muzzle end of a firearm and the inlet end coupling feature of the second device is removably coupleable with the outlet end coupling feature of the first device beyond the muzzle end of the firearm, wherein the first device further comprises an off axis chamber and an outlet for the off axis chamber at the outlet end, and the second device further comprises an off axis chamber having an inlet, and wherein the outlet end coupling feature of the first device is removably coupleable with the inlet end coupling feature of the second device such that the off axis chamber outlet of the first device is alignable with the off axis chamber inlet of the second device.

15. The system of claim 14, wherein the second device has a function different than a function of the first device.

16. The system of claim 15, wherein the first device function and the second device function is selected from the group consisting of a sound suppressor, a flash suppressor, a gas redirector, a back pressure controller, a debris controller, an acoustic and heat controller and combinations thereof.

17. The system of claim 14, further comprising:

a third firearm muzzle mountable device having an inlet end coupling feature proximate to an inlet end of a central chamber, the central chamber being oriented along a central axis and the inlet being configured to allow the projectile from the firearm to pass along the central axis, wherein the inlet end coupling feature of the third device is removably coupleable with the outlet end coupling feature of the first device or the second device.

18. An interchangeable, modular firearm muzzle mountable system, comprising:

a first firearm muzzle mountable device and a second firearm muzzle mountable device, each device having an inlet end coupling feature proximate to an inlet end of a central chamber, and an outlet end coupling feature proximate to an outlet of the central chamber, the central chamber being oriented along a central axis within an outer shell and the inlet and the outlet being configured to allow a projectile from a firearm to pass along the central axis, wherein the inlet end coupling feature of the first device is removably coupleable with a muzzle end of a firearm and the inlet end coupling feature of the second device is removably coupleable with the outlet end coupling feature of the first device beyond the muzzle end of the firearm, and wherein the first device further comprises an off axis chamber having a common chamber among a plurality of inlets or openings.

19. The system of claim 18, wherein the second device has a function different than a function of the first device.

20. The system of claim 19, wherein the first device function and the second device function is selected from the group consisting of a sound suppressor, a flash suppressor, a gas redirector, a back pressure controller, a debris controller, an acoustic and heat controller and combinations thereof.

21. The system of claim 18, further comprising:

a third firearm muzzle mountable device having an inlet end coupling feature proximate to an inlet end of a central chamber, the central chamber being oriented along a central axis and the inlet being configured to allow the projectile from the firearm to pass along the central axis, wherein the inlet end coupling feature of the third device is removably coupleable with the outlet end coupling feature of the first device or the second device.

* * * * *